US006914388B2

(12) United States Patent
Shin et al.

(10) Patent No.: US 6,914,388 B2
(45) Date of Patent: Jul. 5, 2005

(54) ORGANIC LIGHT EMITTING DIODE DISPLAY DEVICE DRIVING APPARATUS AND DRIVING METHOD THEREOF

(75) Inventors: Hong-Jae Shin, Seoul (KR); Kae-Dal Kwack, Seoul (KR)

(73) Assignee: Hana Micron Inc., Chungcheongnam-do (KR)

( * ) Notice: Subject to any disclaimer, the term of this patent is extended or adjusted under 35 U.S.C. 154(b) by 0 days.

(21) Appl. No.: 10/668,206

(22) Filed: Sep. 24, 2003

(65) Prior Publication Data

US 2004/0104686 A1 Jun. 3, 2004

(30) Foreign Application Priority Data

Nov. 29, 2002 (KR) ..... 10-2002-0075470

(51) Int. Cl.[7] ..... G09G 3/10

(52) U.S. Cl. ..... 315/169.2; 315/169.3; 345/76

(58) Field of Search ..... 315/160–161, 315/164, 169.1, 169.3, 169.2; 345/204–205, 211, 76, 82, 84

(56) References Cited

U.S. PATENT DOCUMENTS 6,366,116 B1 * 4/2002 Juang ..... 326/37
2003/0151570 A1 * 8/2003 LeChevalier ..... 345/84
2003/0156101 A1 * 8/2003 LeChevalier ..... 345/204
2003/0169241 A1 * 9/2003 LeChevalier ..... 345/204
2003/0173904 A1 * 9/2003 LeChevalier ..... 315/169.3
2004/0004590 A1 * 1/2004 LeChevalier ..... 345/82
2004/0085086 A1 * 5/2004 LeChevalier ..... 324/770

* cited by examiner

*Primary Examiner*—Thuy V. Tran
(74) *Attorney, Agent, or Firm*—Greenblum & Bernstein, P.L.C.

(57) ABSTRACT

There are provided an organic light emitting diode (OLED) display driving apparatus and a driving method thereof, in which the OLED display panel driving apparatus of a passive matrix type is configured such that its scan driving circuit has 3-state output, and the cathode lines, selected when the scan driving circuit performs a scan operation, maintain grounding, and after data-applied OLED emits light, are switched in a high voltage, and execute a refresh operation to initialize the pixel charges, and with the high impedance state maintained, non-selective common cathode lines turn into a high impedance state so as to remove the parasitic capacitance elements, and reduce the capacitance element functioning as the load of the data driving circuit connected to the OLED anode lines, and without the use of precharge method of maintaining the anode lines above a predetermined voltage quickly by using a voltage source, and applying data by using a current source, the anode lines can be charged within a short time just by necessary current for the lightening of the OLED so as to reduce the power consumption of the data driving circuit, and increase the operation speed.

11 Claims, 9 Drawing Sheets

[FIG. 1]
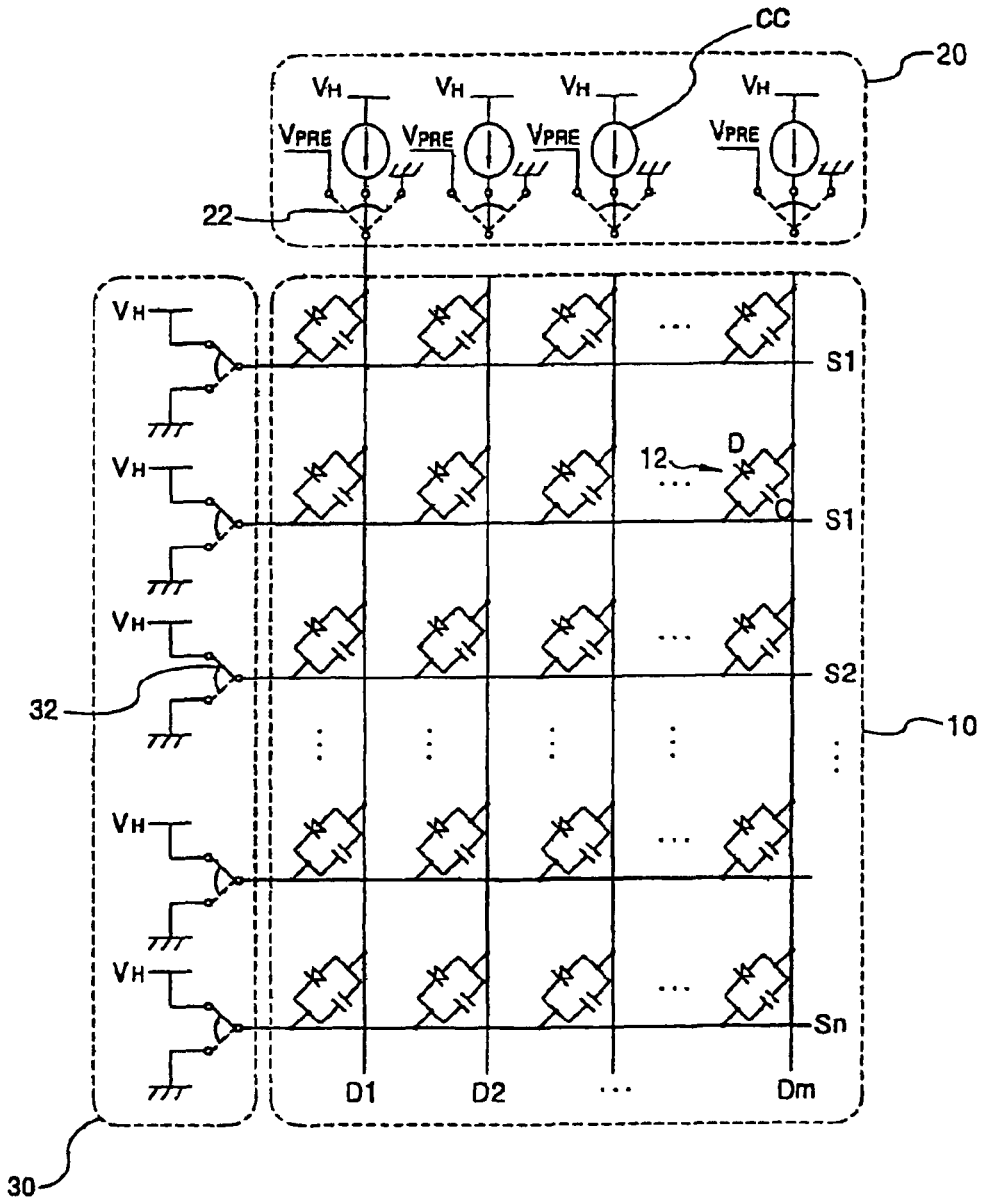

[FIG. 2]
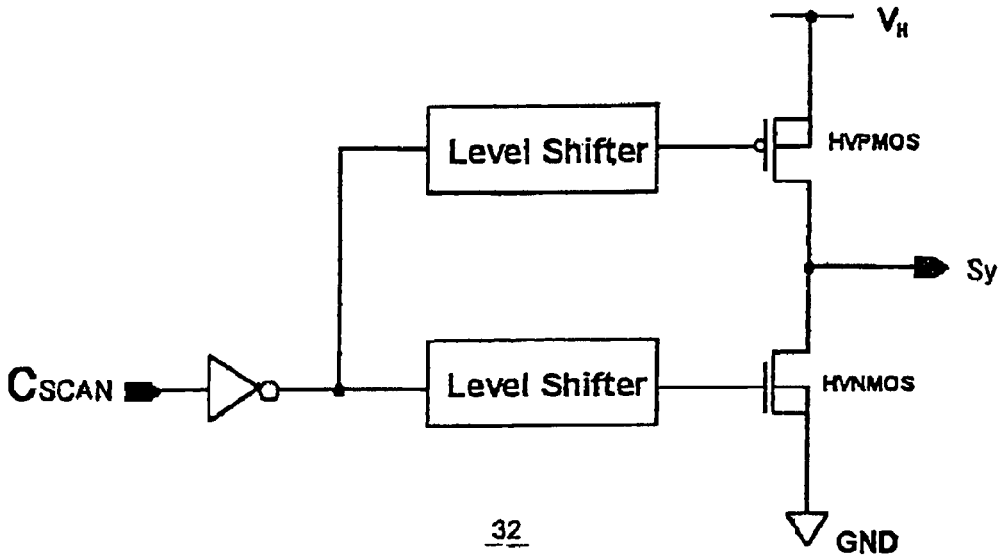
CONVENTIONAL ART
[FIG. 3]
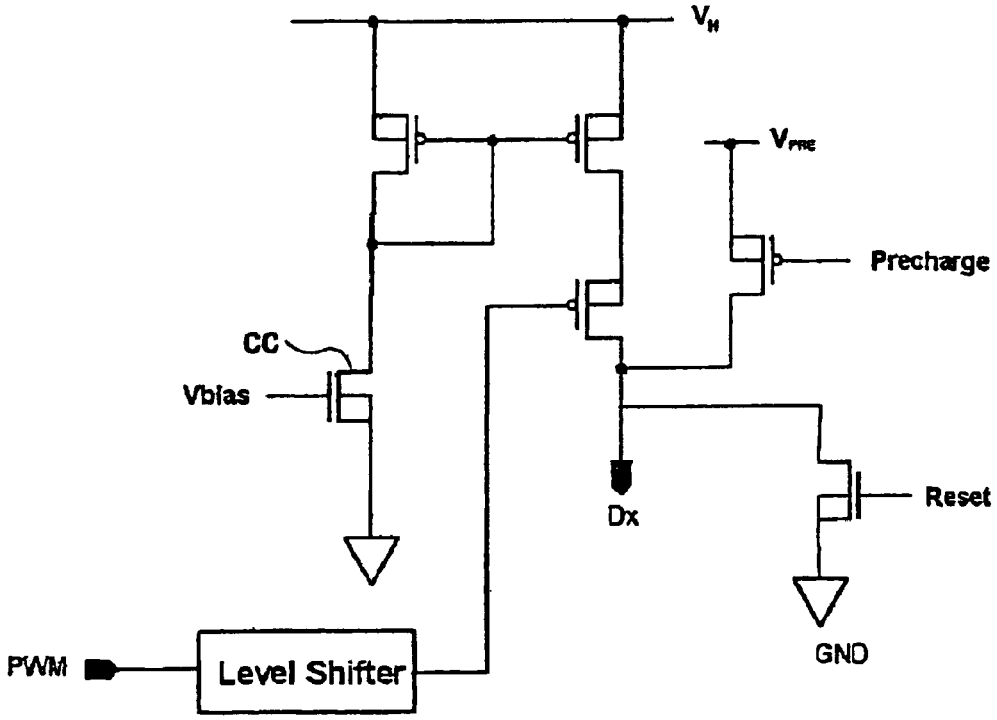

[FIG. 4]
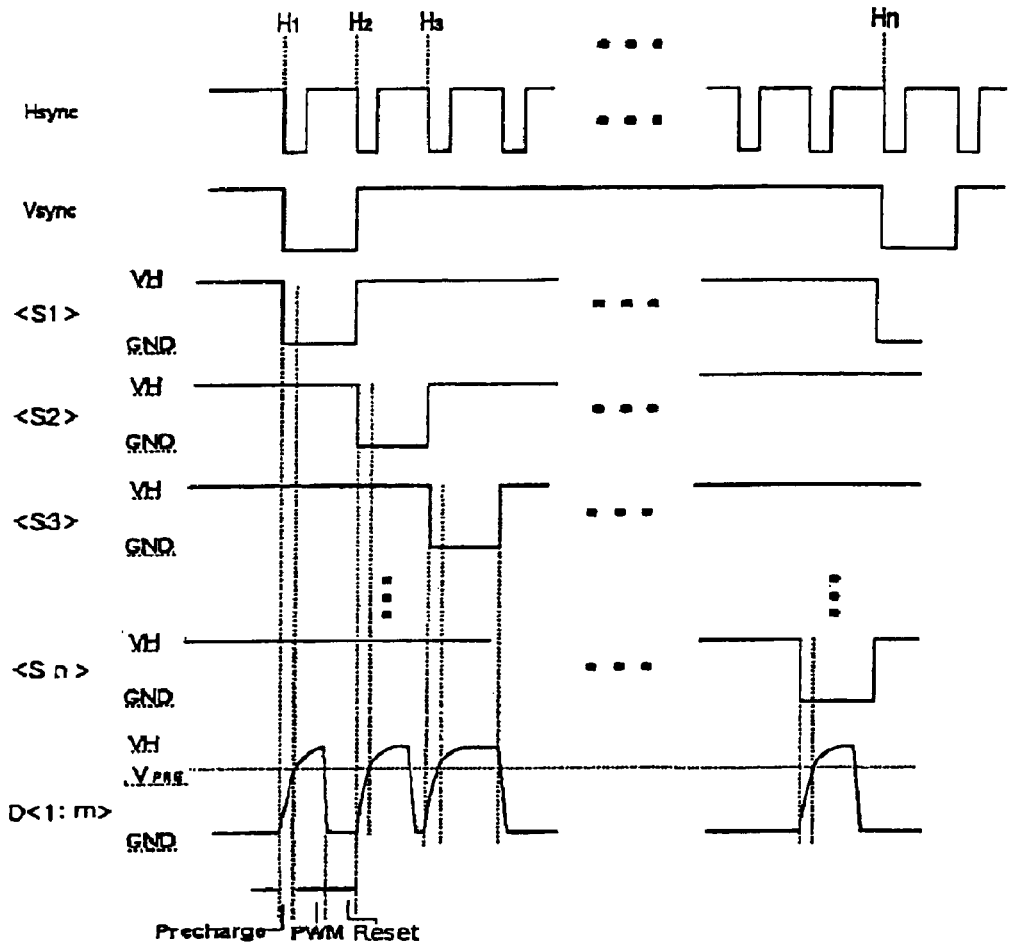

[FIG. 5]
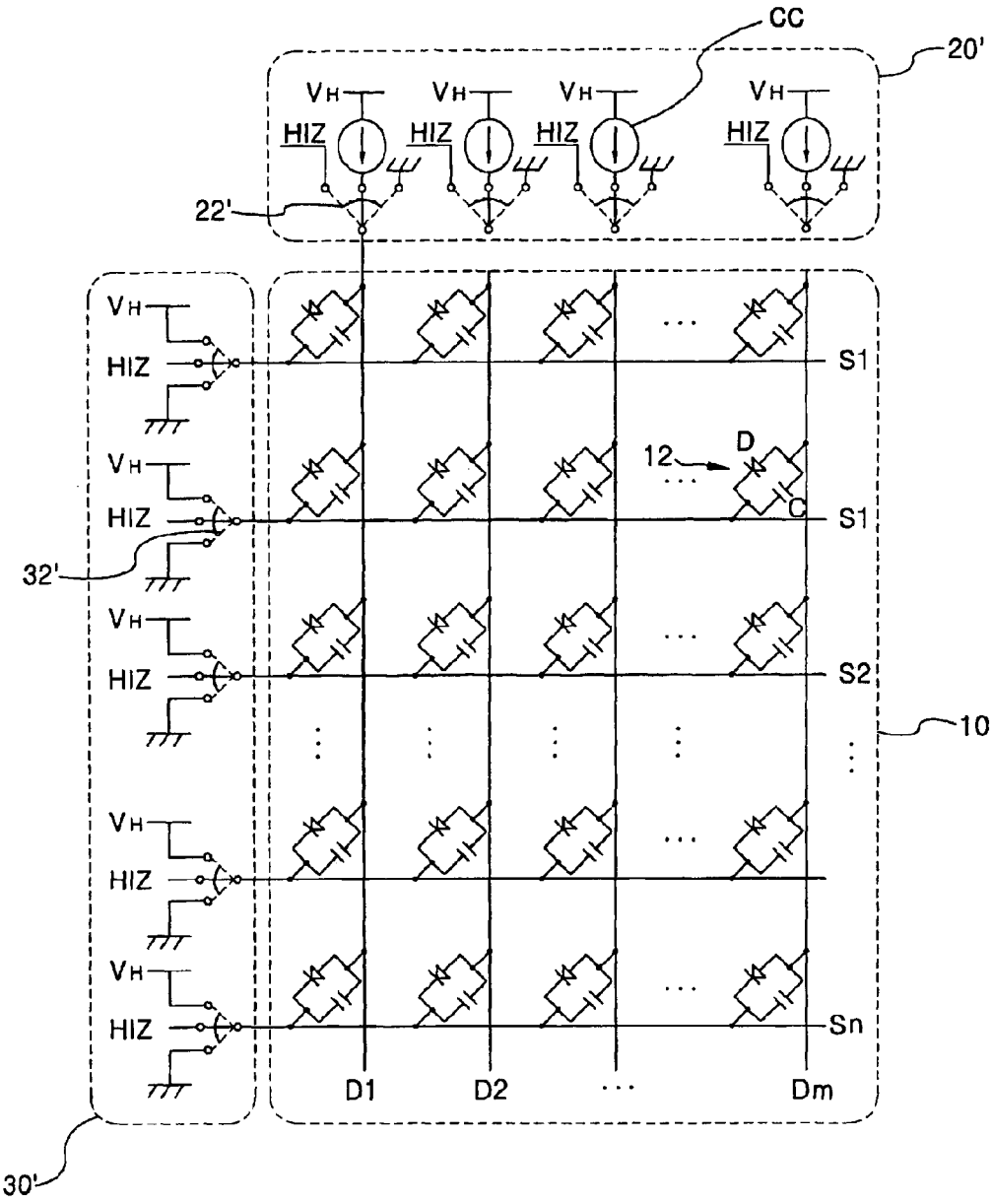

[FIG. 6]
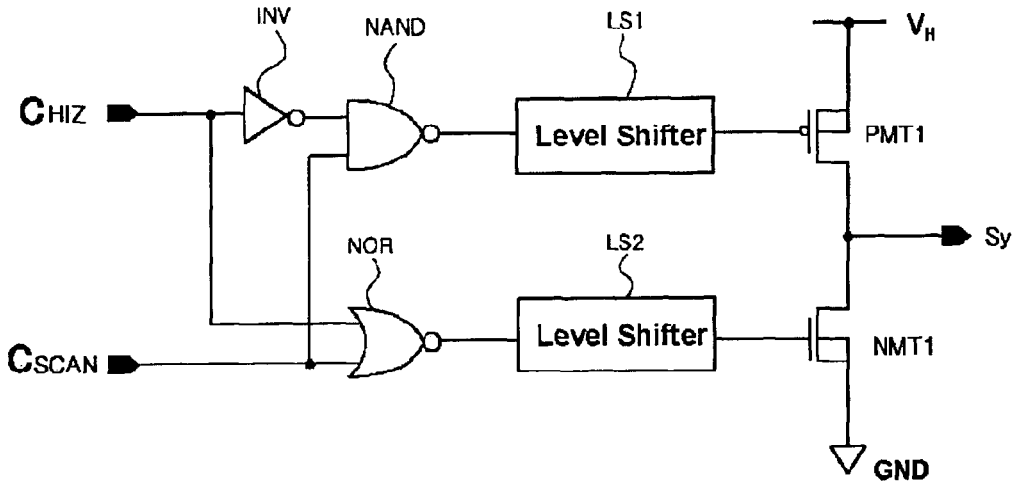
[FIG. 7]
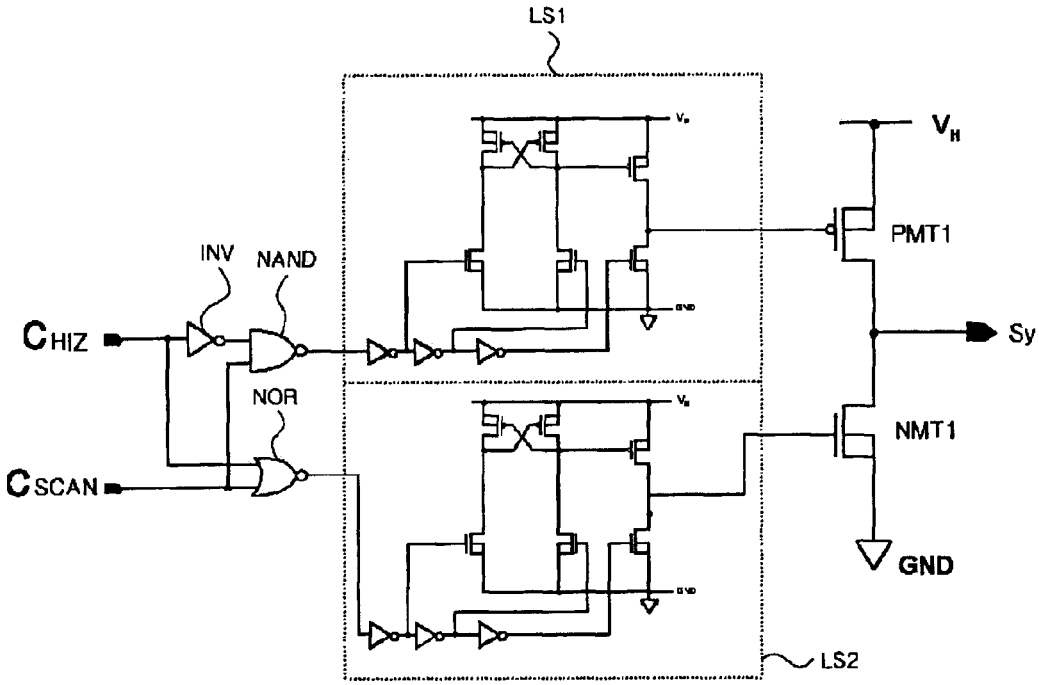

[FIG. 8]
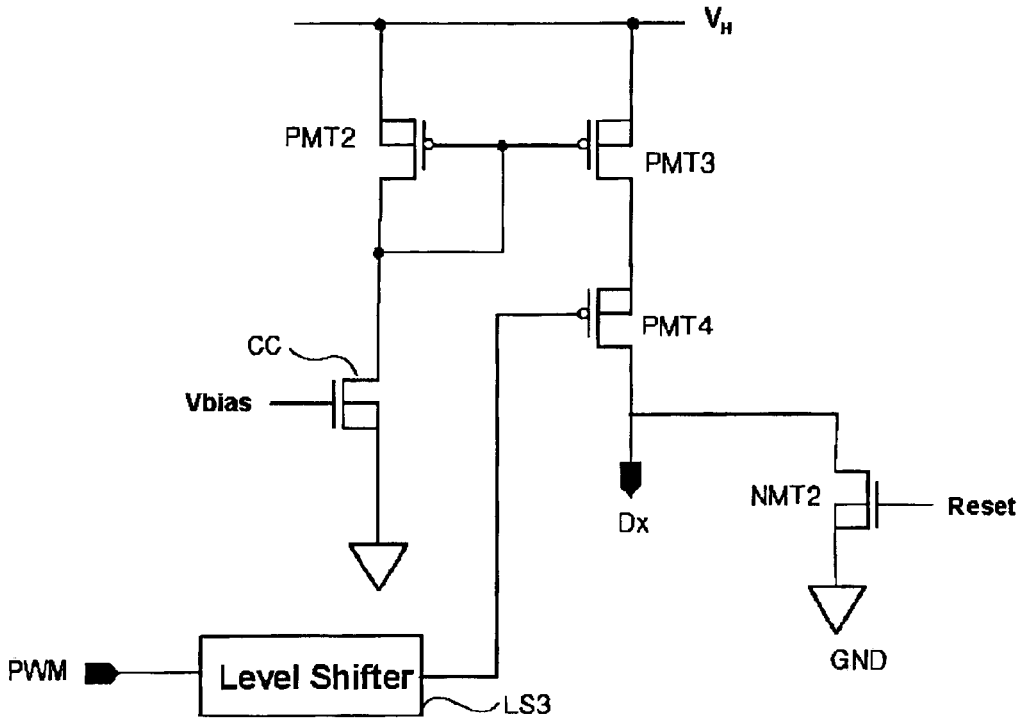

[FIG. 9]
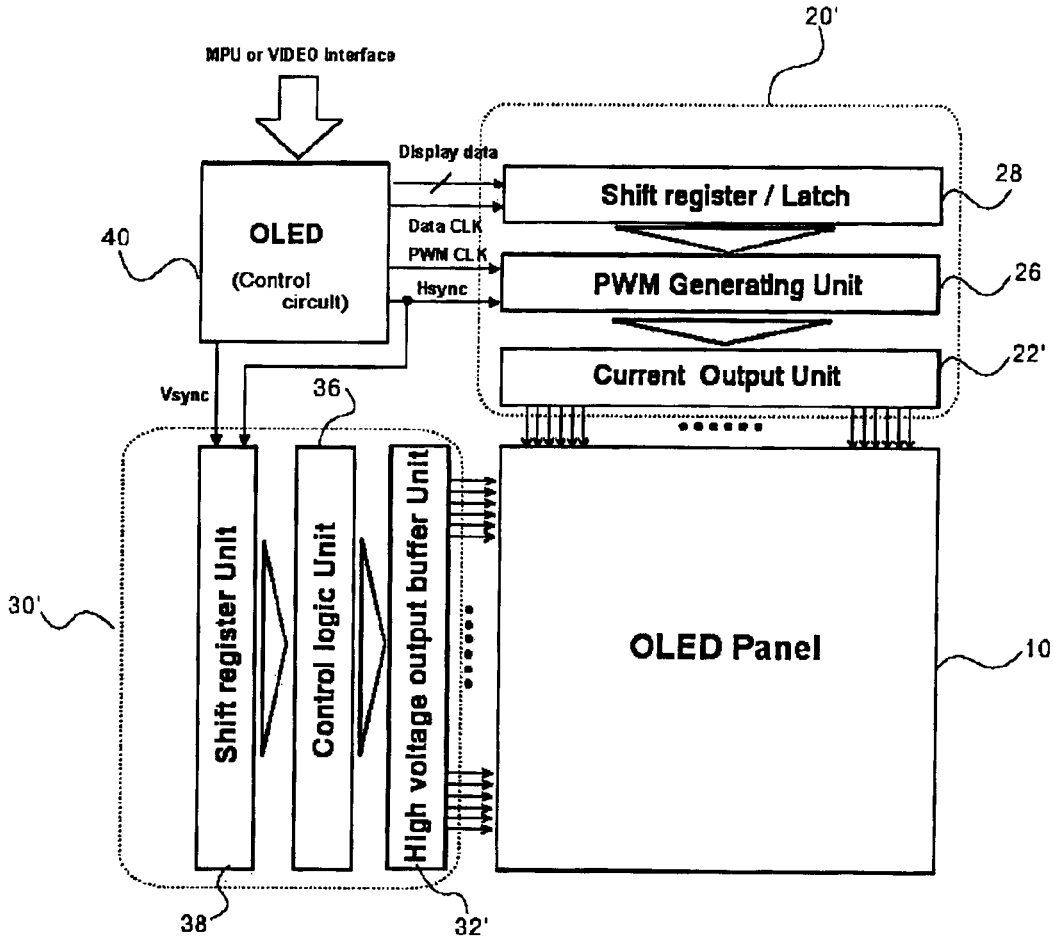

[FIG. 10]
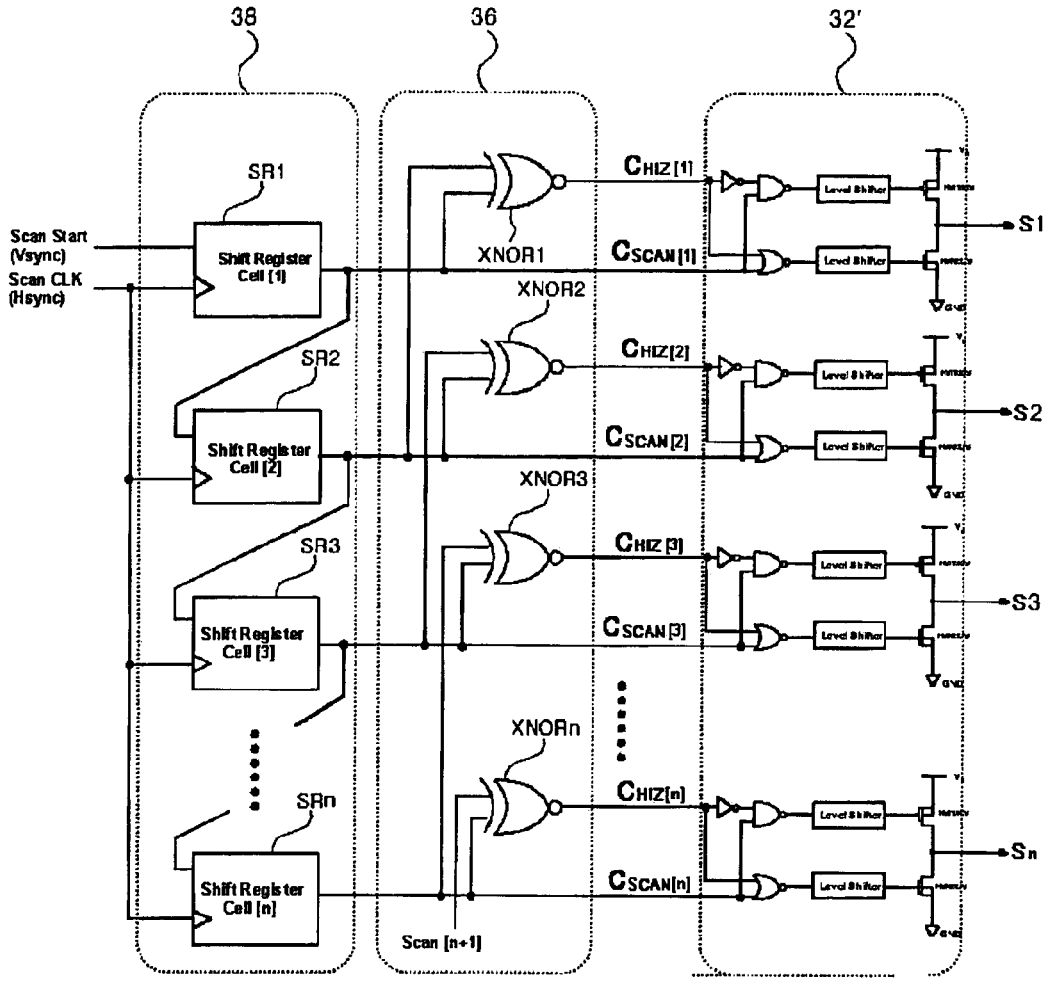

[FIG. 11]
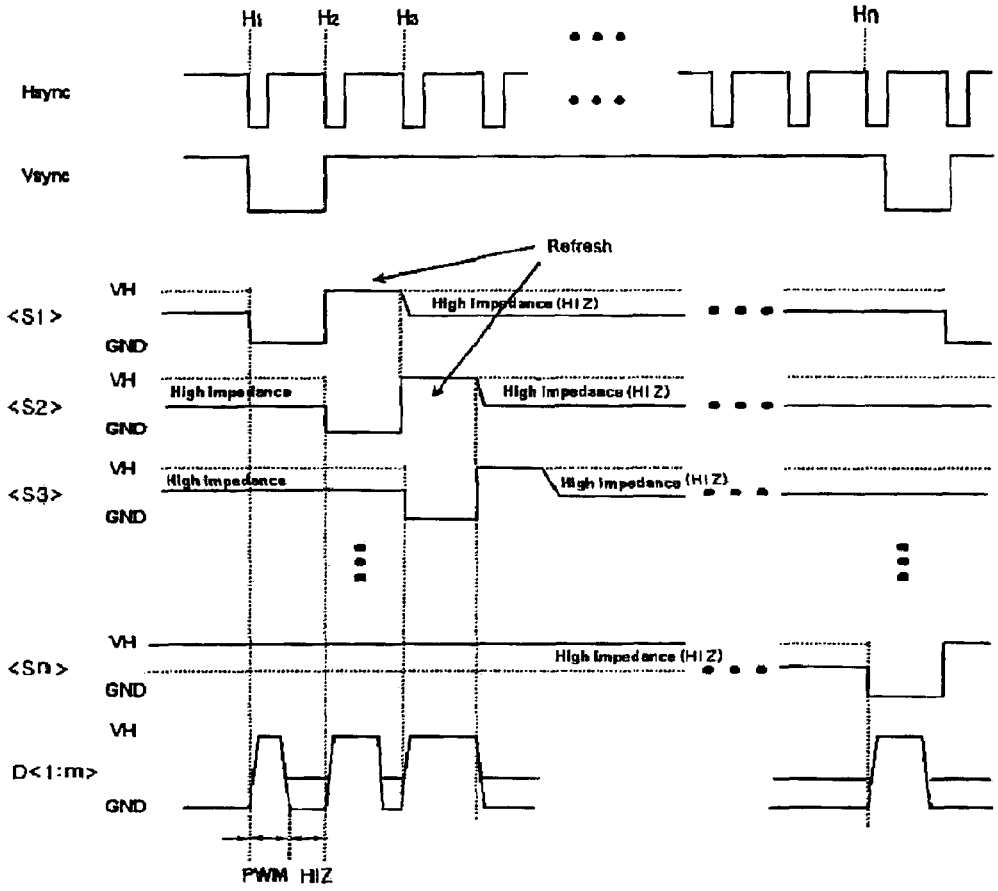

ORGANIC LIGHT EMITTING DIODE DISPLAY DEVICE DRIVING APPARATUS AND DRIVING METHOD THEREOF

BACKGROUND OF THE INVENTION

1. Field of the Invention

The present invention relates to an organic light emitting display device driving apparatus and a driving method thereof, and more particularly to an organic light emitting diode (OLED) display device driving apparatus and a driving method thereof for reducing the power consumption of the driving apparatus and increasing the driving speed by making a scan driving circuit in the passive matrix typed OLED display driving apparatus have 3-state output. (Herein after, it will be referred to as OLED panel driving apparatus.)

2. Background of the Related Art

A liquid crystal display device is widely used as an image display device of one of TV, a computer, or a portable phone, but it has disadvantages of being thick, heavy, and slow response speed since it requires a back light installed therein. An organic light emitting diode (OLED) display panel is recognized as an image display device which can replace such a display as above (Herein after, it will be referred to as 'OLED panel'.). The OLED panel includes a very thin organic film being 0.1 $\mu$m or being less than 0.1 $\mu$m in thickness. When electric current is applied to the organic thin film, electrons and holes are recoupled near the interface of an electron transport layer and a hole transport layer so as to emit light. The light-emitting shows very fast response time less than hundreds of nano seconds. As such, OLED is composed of two polar structure groups, and it is driven by an electric current due to the difference of voltage-current characteristics of a discrete OLED to form a panel.

FIG. 1 is a schematic block diagram of a conventional free charge type of an OLED panel driving apparatus. As shown in FIG. 1, an OLED panel 10 includes a plurality of common anode lines D1, . . . , Dm) and a plurality of common cathode lines S1, . . . , Sn, which intersect in a matrix shape, and an OLED 12 is placed at each intersecting point of the matrix, to form a pixel (one pixel being composed of R/G/B.) A data driving circuit 20 is connected to the common anode lines D1, . . . , Dm, and a scan driving circuit 30 is connected to the common cathode lines S1, . . . , Sn.

A scan driving circuit 30 includes a scan output unit 32 which selectively connects the common cathode lines S1, . . . , Sn to a high voltage terminal $V_H$ (for example, 15 V) and a grounding earth by a predetermined pattern in accordance with the control of a controlling unit (not shown). FIG. 2 is a detailed circuit diagram of a scan output unit with respect to one of the common cathode lines of FIG. 1. As shown in FIG. 2, the scan output unit 32 selectively connects one common cathode line $S_y$ to a high voltage terminal $V_H$ or a grounding earth GND in accordance with the logic level of a control signal $C_{SCAN}$ from an outer controlling unit (not shown).

FIG. 3 is a detailed circuit diagram of a data output unit with respect to one common anode line of FIG. 1. As shown in FIG. 3, the data output unit 22 selectively connects each of the common anode lines D1, . . . , Dm to a constant current source CC or a grounding earth GND in accordance with the control of a controlling unit (not shown).

In the structure described as above, if the scan output unit 32 turns "on" or "off" alternately so as to select any one of the common cathode lines from a first row S1 to an nth row Sn, the data output unit 22 connects the common anode lines D1, . . . , Dm to the constant current source CC for the time width varied by Pulse Width Modulation (PWM) method in accordance with the gray scale of a corresponding pixel, that is, the OLED 12 with synchronized thereto, and a current is applied to the corresponding OLED 12 so as to form one display frame.

In the meantime, a parasitic capacitor C exists on the both ends of the anode and the cathode of a diode D since the OLED 12 is composed of an organic thin film, which causes a problem of not-treating of low gray scale in the presence of the parasitic capacitor C. Thus, conventionally, a voltage is applied just as much as to turn "on" the diode D before PWM current is applied on the common anode lines D1, . . . , Dm so that the parasitic capacitor C is precharged. Then, for the purpose, a predetermined voltage, for example, precharge voltage terminal $V_{PRE}$ of about 4~6 V is further provided on the data output unit 22.

FIG. 4 is a timing chart to illustrate the relations of a scan output timing for one image frame in the conventional precharge-typed OLED panel driving apparatus, and a precharge interval and a data output interval in each scan output interval. As shown in FIG. 4, the vertical synchronization signal $V_{sync}$ is generated every one frame of display, and horizontal synchronization signals $H_{sync}$ is generated having the same number as that of the common cathode lines n, in the vertical scan period between the vertical synchronization signal $V_{sync}$, and data is applied to the all common anode lines D1, . . . , Dm in the horizontal scan period between the horizontal synchronization signal $H_{sync}$ at the same time. That is, if the scan output unit 32 connects a first row of common cathode line S1 to the grounding earth GND in the high voltage terminal $V_H$ in accordance with the outer control signal $C_{SCAN}$ generated with synchronized to the down edge of each horizontal synchronization signal $H_{sync}$, the data output unit 22 connects the all common anode lines D1, . . . , Dm into a precharge voltage $V_{PRE}$ in accordance with the control of the outer control signal with synchronized thereto for a predetermined time so as to charge the parasitic capacitor C of the OLED 12. Then, the data output unit 22 connects each of the common anode lines D1, . . . , Dm to the constant current source CC in accordance with the control of the outer control signal PWM, for the PWM time predetermined according to the pixel gray of the OLED 12 connected thereto so that the OLED 12 emits light. Then, if the data output unit 22 again connects the common anode lines D1, . . . , Dm to the grounding earth GND in accordance with the control of the outer control signal Reset, the voltage charged in the parasitic capacitor C is discharged. In the same way, the process is executed for up to the nth row of the common cathode line Sn, so as to form a display one frame.

However, according to the OLED panel driving apparatus of the conventional precharge typed OLED panel driving apparatus described as above, since the all parasitic capacitors C, connected thereto in parallel, are repeatedly charged and discharged (eventually, because of the conversion of the voltage polarity of the both ends of the OLED), in the process in which the data output unit 22 operates the common anode lines D1, . . . , Dm, large amount of current is flowed in the OLED panel 10, and the power consumption according thereto is as follows by Equation 1.

$$P_d = n*m*C*V_H^2*f_{clk} \quad \text{[Equation 1]}$$

In the Equation 1, the number from 1 to n presents the number of the common cathode lines, m presents the number of the common anode lines, C presents a parasitic capacitance, $V_H$ presents high voltage applied to the anode, and fclk presents the operation frequency of the scan driving circuit 30. As shown in Equation 1, since the conventional OLED panel driving apparatus requires a large amount of current during charge-discharge, the power consumption is increased, and the operation speed of the data driving circuit is decreased.

SUMMARY OF THE INVENTION

An object of the invention is to solve at least the above problems and/or disadvantages and to provide at least the advantages described hereinafter.

Accordingly, one object of the present invention is to solve the foregoing problems by providing an OLED panel driving apparatus and a driving method thereof, in which the passive matrix typed OLED panel driving apparatus is configured such that its scan driving circuit has 2-state outputs of at least a scan state and a high impedance state, and its power consumption is reduced and the operation speed is increased by removing parasitic capacitance with a non-selective common cathode line in a high impedance state.

Another object of the present invention to provide an OLED panel driving apparatus and a driving method thereof for preventing the degradation caused from the maintenance of the same polarity in the both ends of the OLED, by making its scan driving circuit have 3-state outputs of high voltage state, scan state and high impedance state, and by making the non-selective common cathode line in high voltage state before turning into high impedance state so as to invert the polarity of its parasitic capacitance.

The foregoing and other objects and advantages are realized by providing an OLED panel driving apparatus having an OLED in each intersecting point of a plurality of common anode lines and a plurality of common cathode lines, which are aligned in a matrix configuration, to form a pixel, in which the OLED panel driving apparatus may include a data driving circuit connected to a plurality of common anode lines, and having a plurality of data output unit selectively connecting each of the common anode lines to a constant current source or a high impedance terminal HIZ; and a scan driving circuit connected to the plurality of common cathode lines, and having a plurality of scan output units selectively connecting each of the common cathode lines at least to a high impedance terminal HIZ or a grounding earth. Preferably, the scan output unit may further include a high voltage terminal to selectively connect each of the common cathode lines to the high voltage terminal, the high impedance terminal HIZ or the grounding earth. The scan output unit may preferably further include a high voltage terminal to selectively connect each of the common cathode lines to the high voltage terminal, the high impedance terminal HIZ or the grounding earth.

Further, a data driving circuit having a plurality of data output units selectively connected to the grounding earth is further provided. There is also provided an OLED control circuit for generating various signals including a horizontal synchronization signal, a vertical synchronization signal and a display data signal.

Further, the scan driving circuit may include a scan output unit; a shift register unit for generating a scan control signal $C_{SCAN}$ with respect to the common cathode line; and a control logic unit for executing the logic processing of the scan control signal $C_{SCAN}$ supplied from the shift register unit in order to generate a high impedance control signal $C_{HIZ}$, and to supply to the scan output unit.

Further, the scan output unit may include an inverter gate, its input end being connected to the high impedance control signal end $C_{HIZ}$; a NOR gate, its one input end being connected to the scan control signal end $C_{SCAN}$, and its the other input end being connected to the high impedance control signal end $C_{HIZ}$; a NAND gate, its one input end being connected to the scan control signal end $C_{SCAN}$, and its the other input end being connected to the output end of the inverter gate; a first level shifter being connected to the output end of the NAND gate and converting logic level into the high voltage level; a second level shifter being connected to the output end of the NOR gate and converting logic level into the high voltage level; a first PMOSFET having a gate connected to the first level shift and a source connected to the high voltage terminal; and a first NMOSFET having a gate connected to the second level shift, a drain connected to the drain of the first PMOSFET, and a source being grounded, and the common cathode lines are connected to the first PMOSFET and the drain of the first NMOSFET.

Further, the shift register unit may be configured to have shift registers as many as the number of the common cathode lines; the vertical synchronization signal is applied to data input end of a first row of a shift register in the shift registers; the horizontal synchronization signal is applied to the all clock ends of the shift register; and the output of one row of the shift registers is connected to a corresponding row of a scan control signal end $C_{SCAN}$ in the scan output unit, and to a data input end of a next row of the shift register.

Further, the control logic unit may be configured to have 2-input XNOR gates as many as the number of the common cathode lines; one input end of each of the XNOR gates is connected to the output end of its corresponding row of the shift register; the other input end of each of the XNOR gates is connected to the output end of a next row of the shift register; and the output end is connected to the high impedance control signal end $C_{HIZ}$ of its corresponding row of the scan output unit.

Further, wherein the data driving circuit may include a data output unit; a shift register/latch unit for sequentially shifting and storing the data applied to the common anode line in accordance with the control signal from the OLED control circuit; and a PWM generating unit for converting the data supplied from the shift register/latch unit into a control signal PWM having various time width in accordance with gray level of the data, and supplying to the data output unit.

Further, the data output unit may include a second PMOSFET and a third PMOSFET to form current mirror circuits; a third level shifter for converting the logic level of the control signal PWM supplied from the PWM generating unit into the high voltage level; and a fourth PMOSFET for selectively connecting the common anode line to the constant current source and the high impedance terminal HIZ with "on"/"off" by the third level shifter.

Further, a second NMOSFET is provided for grounding the common anode line with "on" by an outer control signal Reset in the "off" state of the fourth PMOSFET.

In another aspect of the present invention, a method of driving an OLED panel of the present invention is provided, in which the OLED panel has an OLED in each intersecting point of a plurality of common anode lines and a plurality of common cathode lines, which are aligned in a matrix configuration, to form a pixel, and the method may include the step of maintaining, in a high impedance state, the common cathode lines in the rest of the rows except one row of the currently scanned common cathode line while being sequentially scanned after converted into grounding level GND in the process of applying constant current to the common anode lines by a control signal PWM having various time width in accordance with gray level of displayed pixel data.

Further, the driving method of the present invention is characterized in that the row of the common cathode line right prior to the row of the currently scanned common cathode line is connected to a high voltage terminal so as to invert the polarity of the parasitic capacitance and prevent the degradation of the OLED.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein:

FIG. 1 is a schematic block diagram of a conventional precharge-typed OLED panel driving apparatus;

FIG. 2 is a detailed circuit diagram of FIG. 1 to illustrate a scan output unit relative to one common cathode line;

FIG. 3 is a detailed circuit diagram of FIG. 1 to illustrate a data output unit relative to one common anode line;

FIG. 4 is a timing chart to illustrate the relations of a scan output timing for one image frame in the conventional precharge-typed OLED panel driving apparatus, and a precharge interval and a data output interval in each scan output interval;

FIG. 5 is a block diagram of an OLED panel driving apparatus of the present invention;

FIG. 6 is a block diagram of a scan output unit relative to one common cathode line of FIG. 5;

FIG. 7 is a detailed circuit diagram of FIG. 6;

FIG. 8 is a block diagram of a data output unit relative to one common anode line of FIG. 5;

FIG. 9 is a block diagram of an OLED panel driving apparatus of the present invention;

FIG. 10 is a detailed circuit diagram of a scan driving circuit of FIG. 9; and FIG. 11 is an operation timing diagram of a scan driving circuit and a data driving circuit to illustrate a method of driving an OLED panel of the present invention.

DETAILED DESCRIPTION OF PREFERRED EMBODIMENTS

The following detailed description will present a driving apparatus of an OLED panel, and a driving method thereof according to a preferred embodiment of the invention in reference to the accompanying drawings.

FIG. 5 is a block diagram of an OLED panel driving apparatus of the present invention. As shown in FIG. 5, the OLED panel 10 is composed of a plurality of common anode lines D1, . . . , Dm and a plurality of common cathode lines S1, . . . , Sn, which are aligned in a matrix shape, and an OLED 12 is located in each of the intersecting points so as to form a pixel. A data driving circuit 20' is connected to the common anode lines D1, . . . , Dm, and a scan driving circuit 30' is connected to the common cathode lines S1, . . . , Sn.

The scan driving circuit 30' includes a scan output unit 32', which selectively connects the common cathode lines S1, . . . , Sn to a high voltage terminal. (for example, 15V) $V_H$, a high impedance terminal HIZ, and a grounding earth GND in predetermined patterns in accordance with the control of a control unit (not shown). The high voltage terminal $V_H$ is provided to prevent the OLED 12 from being degraded, which is caused from that the both ends of the OLED 12 is continuously maintained in the same polarity, by inverting the polarity of a parasitic capacitor, that is, the voltage polarity of the both ends of the OLED 12. Its operation will be described herein after.

FIG. 6 is a block diagram of a scan output unit relative to one common cathode line of FIG. 5. As shown in FIG. 6, each scan output unit 32' includes an inverter gate INV, its input end being connected to a high impedance control signal end $C_{HIZ}$, a NOR gate, its input end being connected to a scan control signal end $C_{SCAN}$, and its the other input end being connected to a high impedance control signal end $C_{HIZ}$, NAND gate, its one input end being connected to a scan control signal end $C_{SCAN}$, and its the other end being connected to the output end of an inverter gate INV, a first level shift LS1 being connected to the output end of the NAND gate NAND to convert its logic level Vcc to a high voltage level $V_H$, a second level shift LS2 being connected to the output end of the NOR gate NOR to convert its logic level Vcc to a high voltage level $V_H$, PMOSFET PMT1, a gate being connected to the first level shift LS1, and a source being connected to the high voltage terminal $V_H$, and NMOSFET NMT1, a gate connected to the second level shift LS2, and a drain being connected to the drain of the PMOSFET PMT1, and a source grounded, and the common cathode line $S_y$ is connected to the drains of PMOSFET PMT1 and NMOSFET NMT1.

In the structure described as above, if a logic signal "0" is output from an outer control unit (not shown) to the scan control signal end $C_{SCAN}$ and the high impedance control signal end $C_{HIZ}$ respectively, a logic signal "1" is output from the NAND gate NAND and NOR gate NOR respectively, and the logic signal "1" is converted into a high voltage level $V_H$ in the first level shift LS1, and the second level shift LS2, and so, the common cathode line $S_y$ is connected to a grounding earth GND with the PMOSFET PMT1 being "off", but the NMOSFET NMT1 being "on".

If a logic signal "1" is output to the scan control signal end $C_{SCAN}$, and a logic signal "0" is output to the high impedance control signal end $C_{HIZ}$ respectively, a logic signal "0" is output from the NAND gate NAND and NOR gate NOR respectively, and the logic signal "0" is converted into a low voltage level in the first level shift LS1 and the second level shift LS2, and so, the common cathode line $S_y$ is connected to a high voltage terminal $V_H$ with the PMOSFET PMT1 being "on", but the NMOSFET NMT1 being "off".

In the meantime, if a logic signal "1" is output to the high impedance control signal end $C_{HIZ}$, a logic signal "1" is output from the NAND gate NAND regardless the level of the logic signal input to the scan control signal end $C_{SCAN}$, and a logic signal "0" is output from the NOR gate NOR. Accordingly, the PMOSFET PMT1 and the NMOSFET NMT1 are all "off", and the common cathode line $S_y$ gets into a state of being connected to the high impedance terminal HIZ functionally, that is, in a floating state. Table 1 is a truth table to show the above operation.

TABLE 1

| $C_{SCAN}$ | $C_{HIZ}$ | VNAND | VNOR | PMOSFET | NMOSFEt | $S_y$ |
|---|---|---|---|---|---|---|
| 0 | 0 | 1 | 1 | Off | On | GND |
| 1 | 0 | 0 | 0 | On | Off | $V_H$ |
| 0 | 1 | 1 | 0 | Off | Off | HIZ |
| 1 | 1 | 1 | 0 | Off | Off | HIZ |

FIG. 7 is a detailed circuit diagram of the scan output unit in FIG. 6.

In the meantime, a data output unit 22' selectively connects each of the common anode lines D1, . . . , Dm to a constant current source CC and a high impedance terminal HIZ in accordance with the control of a control unit (not shown). FIG. 8 is a block diagram of a data output unit relative to one common cathode line of FIG. 5. As shown in FIG. 8, the data output unit 22' includes two PMOSFETs forming current mirror circuits PMT2, PMT3, a constant current source CC being connected to the current mirror circuits, a third level shift LS3 converting the logic level of an outer control signal PWM into a high voltage level $V_H$, and a PMOSFET PMT4 for applying a constant current to the common anode line $D_x$ with the "on"/"off" by the third level shift LS3. In the drawing, a reference number NMT2 presents NMOSFET for grounding the common anode line $D_x$ turning "on" by an outer control signal Reset in the "off" state of the PMOSFET PMT4.

FIG. 9 is a block diagram of an OLED panel driving apparatus of the present invention. As shown in FIG. 9, the OLED panel driving apparatus of the present invention mainly includes a scan driving circuit 20', a data driving circuit 30', and an OLED control circuit 40 for outputting various clock signals PWM CLK, Data CLK, etc. and Display data and control signal $V_{sync}$, $H_{sync}$, etc. to the scan driving circuit 20' and the data driving circuit 30'.

In the aforementioned structure, the data driving circuit 20' includes an aforementioned data output unit 22' (it is referred to as "current output unit" in the drawing after a typical term in the related art), a shift register/latch unit 28 for sequentially shifting and storing R,G,B display data applied from the OLED control circuit 40 with synchronized by a data clock signal CLK, that is, the data finally applied to the common anode lines D1, . . . , Dm, and a PWM generating unit 26 for converting the data supplied from the shift register/latch 28 into signal having different time width in accordance with the gray level, and supplying to the data output unit 22'. The OLED control circuit 40 supplies PWM clock signal PWM CLK to the PWM generating unit 26.

Further, the scan driving circuit 30' includes an aforementioned scan output unit 32' (it is referred to as "high voltage output buffer unit" in the drawing after a typical term in the related art), a shift register unit 38 for generating a scan control signal $C_{SCAN}$ with respect to the common cathode lines S1, . . . ,Sn selected in accordance with a horizontal synchronization signal $H_{sync}$ supplied from the OLED control circuit 40, and a control logic unit 36 executing logic-processing for the scan control signal $C_{SCAN}$ supplied from the shift register unit 38, and generating a scan control signal $C_{SCAN}$ and a high impedance control signal $C_{HIZ}$, and supplying to the scan output unit 22'.

FIG. 10 is a detailed circuit diagram of a scan driving circuit of FIG. 9. As shown in FIG. 10, the shift register unit 38 is configured such that unit shift registers SR1, . . . , SRn having the same number as that of the common cathode lines, n, are aligned in series, and horizontal synchronization signals $H_{sync}$ are supplied to the clock ends of the all shift registers SR1, . . . , SRn. Then, to the data input end of the first row of the shift register SR1, a vertical synchronization signal, being output from the OLED control circuit 40, is supplied, and in the rest of the shift registers SR1, . . . , SRn, the output of any row of the shift register SRy is directly connected to a corresponding scan control signal end $C_{SCAN}$ of the scan output unit 32', and at the same time, is connected to the data input end of the next row of the shift register SRy+1. The shift registers SR1, . . . , SRn are composed of negative-truth logic circuits, and structured to operate at the down-edges of the data signal and clock signal.

A control logic unit 36 has 2-inputs, and is also composed of unit XNOR gates XNOR1, . . . , XNORn as many as the number of the common cathode lines, n, and one input end of each row of the XNOR gate XNORy is connected to the output end of its corresponding row of the shift register $SR_y$, and the other input end is connected to the output end of next row of the shift register $SR_{y+1}$, and the output end is connected to the corresponding high impedance control signal end $C_{HIZ}$ of the scan output unit 32'.

Now herein after, the operation of the OLED panel driving apparatus of the present invention and its method will be explained in detail.

FIG. 11 is an operation timing diagram of a scan driving circuit and a data driving circuit to illustrate a method of driving an OLED panel of the present invention. As shown in FIG. 11, a vertical synchronization signal $V_{sync}$ is generated every frame of display, and horizontal synchronization signals $H_{sync}$, being as many as the number of the common cathode lines n, are generated in the vertical scan period between the vertical synchronization signals, and data is applied to the all common anode lines D1, . . . , Dm in the horizontal scan period between the horizontal synchronization signals $H_{sync}$ at the same time. Describing this in more detail, the vertical synchronization signal $V_{sync}$ generated from the OLED control circuit 40 is supplied into the data input end of a first row of the shift register SR1 of the scan driving circuit 30', and at the same time, if the horizontal synchronization signal $H_{sync}$ is supplied to the clock end, the first row of the shift register SR1 operates at the down edge of the vertical synchronization signal $V_{sync}$ and the horizontal synchronization signal $H_{sync}$, and logic signal "0" is output to its output end, that is, a scan control signal end $C_{SCAN}$.

Then, the signals output as above are supplied to a first row of the scan control signal end $C_{SCAN}$ of the scan output unit 32' and to one input end of a first row of XNOR gate XNOR1, and since the other input end of the first row of XNOR gate XNOR1 is connected to the output end of a second row of the shift register SR2, logic signal "0" is output to the output end of the first row of the XNOR gate XNOR1, that is, high impedance control signal end $C_{HIZ}$. Then, logic signal "1" is output into the output ends of the shift registers SR2, . . . , SRn and XNOR gates XNOR2, . . . , XNORn under a second row.

In accordance with the states of the scan control signal $C_{SCAN}$ and the high impedance control signal $C_{HIZ}$, the scan output unit 32' operates as shown in the truth table of the Table 1 so as to connect the first row of the common cathode line S1 to the grounding earth GND in a high impedance state HIZ, that is, in a floating state. Then, in accordance with the control of the outer control signal PWM generated from the PWM generating unit 26 with synchronized by the horizontal synchronization signal H1 in a horizontal scanning period with respect to the first row, with the PMOSFET PMT4 of the data output unit 22' "on", each of the common anode lines D1, . . . Dm is connected to the constant current source CC for a predetermined PWM time in accordance with the pixel gray of the OLED 12 connected thereto so that the OLED 12 emits light, and then, with the PMOSFET PMT4 "off", the common anode lines D1, . . . , Dm maintain a high impedance state HIZ.

In the meantime, while the first row of the common cathode line S1 is selected, the common cathode lines S2, . . . , Sn of the row under the second row are maintained in a high impedance state HIZ, and it can be illustrated as a truth table in Table 2. Further, the letter and numbers presented as italic in the Table 2 and the Tables 3 and 4 mentioned later present the row selected at present.

TABLE 2

| | SR output ($C_{SCAN}$) | XNOR Input 1 | XNOR Input 2 | XNOR output ($C_{HIZ}$) | $S_y$ |
|---|---|---|---|---|---|
| *first row* | *0* | *0* | *1* | *0* | *GND* |
| Under a second row | 1 | 1 | 1 | 1 | HIZ |

Then, in the aforementhioned method, when a second row of the common cathode line S2 is connected to the grounding earth GND in a high impedance state HIZ, that is, in a floating state, the OLED 12 connected thereto emits light, and during the period, when the scan output unit 32' connects the first row of the common cathode line S1 to the high voltage terminal $V_H$ in accordance with the high impedance control signal $C_{HIZ}$ and the scan control signal $C_{SCAN}$, the polarity of the parasitic capacitor C of the OLED 12 connected thereto is inverted, and the degradation of the OLED 12 can be prevented (refresh). The operation can be shown in Table 4 as a truth table.

TABLE 3

| | SR output ($C_{SCAN}$) | XNOR input 1 | XNOR input 2 | XNOR output ($C_{HIZ}$) | $S_y$ |
|---|---|---|---|---|---|
| First row | 1 | 1 | 0 | 0 | $V_H$ |
| *Second row* | *0* | *0* | *1* | *1* | *GND* |
| Under third row | 1 | 1 | 1 | 1 | HIZ |

Then, a three row of the common cathode line S3 is connected to a grounding earth GND, and while the OLED 12 connected thereto emits light, the second row of the common cathode line S2 is connected to a high voltage terminal $V_H$, and the parasitic capacitor C of the OLED 12 connected thereto is discharged. Then, sequentially while the OLED 12 connected to the last row of the common cathode line Sn emits light, the OLED 12 connected to the first row of the common cathode line S1 maintains a high impedance state by an outer control signal $C_{HIZ}$. The operation can be shown in Table 4 as a truth table.

TABLE 4

| | SR output ($C_{SCAN}$) | XNOR input 1 | XNOR input 2 | XNOR output ($C_{HIZ}$) | $S_y$ |
|---|---|---|---|---|---|
| First row | 1 | 1 | 1 | 1 | HIZ |
| Second row | 1 | 1 | 0 | 0 | $V_H$ |
| *third row* | *0* | *0* | *1* | *0* | *GND* |
| Under fourth row | 1 | 1 | 1 | 1 | HIZ |

As described above, in the OLED panel driving method of the present invention, any one row of the common cathode line $S_y$ is sequentially scanned to the grounding level GND in a high impedance state HIZ, and while next row of the common cathode line $S_{y+1}$ is selected (scanned), the row of the common cathode line $S_y$ is connected to a high voltage terminal $V_H$ to invert the polarity of the parasitic capacitor C of the OLED 12 connected thereto, and then, from the point when the next row after the above next row of the common cathode line $S_{y+2}$ is selected (scanned), the row of the common cathode line $S_y$ is maintained in a high impedance state HIZ. As a result, according to the OLED panel driving method of the present invention, the period, in which a parasitic capacitor C is formed between the anode and the cathode of the OLED 12, is only the state in which the common cathode line $S_y$ is connected to a high voltage terminal $V_H$ or the grounding earth GND, and a parasitic capacitance does not exists in the state that it is connected to the high impedance terminal HIZ.

Therefore, in the OLED driving method of the present invention, since the parasitic capacitance exist only in the OLED connected to one common cathode line connected to the grounding earth GND, and the OLED connected to one common cathode line connected to the high voltage terminal $V_H$, desired gray can be expressed without the use of the precharge as in the conventional case, and further, its power consumption can be reduced down to 2/n compared with that of the conventional case. This can be presented as Equation 2 as follows.

$$P_d = 2*m*C*V_H^2*f_{clk} \quad \text{[Equation 2]}$$

In the Equation 2, C presents parasitic capacitor existing in the OLED 12, m presents the number of the common anode lines, $V_H$ presents the high voltage applied to the anode, and fclk presents the operation frequency of the scan driving circuit 30'. For example, in the case of an OLED panel driving apparatus having a resolution of 128×160, since the number n of the cathode lines of the OLED is 160, the power consumption can be reduced down to 1/80.

The OLED panel driving apparatus and the driving method thereof of the present invention are not limited to the exemplary embodiments described as above, and it will be understood that various modifications and applications are possible within the sprit and scope of the present invention.

As described above, according to the OLED panel driving apparatus and the driving method thereof of the present invention, low gray processing is possible just by the PWM data current without the use of the precharge method, so as to reduce the power consumption generated due to the precharge, and allow speedy operation.

While the invention has been shown and described with reference to certain preferred embodiments thereof, it will be understood by those skilled in the art that various changes in form and details may be made therein without departing from the spirit and scope of the invention as defined by the appended claims. For example, while the invention has been described in the specific content of an OLED panel driving apparatus and a driving method thereof, those skilled in the art will appreciate that various applications are possible for the apparatus and method.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An OLED panel driving apparatus having an OLED at each intersection of a plurality of common anode lines and a plurality of common cathode lines, which are aligned in a matrix configuration, to form a pixel, the OLED panel driving apparatus comprising:

a data driving circuit connected to a the plurality of common anode lines, and comprising a plurality of data output units selectively connecting each of the common anode lines to a constant current source or to a high impedance terminal HIZ; and a scan driving circuit connected to the plurality of common cathode lines, and comprising a plurality of scan output units selectively connecting each of the common cathode lines at least to a high impedance terminal HIZ or to ground.

2. The OLED panel driving apparatus according to claim 1, wherein each of the plurality of scan output units comprises a high voltage terminal to selectively connect each of the common cathode lines to the high voltage terminal to the high impedance terminal HIZ or to ground.

3. The OLED panel driving apparatus according to claim 2, further comprising an OLED control circuit for generating signals including a horizontal synchronization signal, a vertical synchronization signal and a display data signal.

4. The OLED panel driving apparatus according to claim 3, wherein the scan driving circuit further comprises:

a shift register that generates a scan control signal $C_{SCAN}$ corresponding to each common cathode line; and a control logic that executes the logic processing of the scan control signal $C_{SCAN}$, supplied from the shift register, to generate a high impedance control signal $C_{HIZ}$, for transmitting to the corresponding scan output unit.

5. The OLED panel driving apparatus according to claim 4, wherein each of the scan output units comprises:

an inverter gate including an input connected to the high impedance control signal $C_{HIZ}$;

a NOR gate including a first input connected to the scan control signal $C_{SCAN}$, and a second input connected to the high impedance control signal $C_{HIZ}$;

a NAND gate including a first input connected to the scan control signal $C_{SCAN}$, and a second input connected to an output of the inverter gate;

a first level shifter connected to an output of the NAND gate and converting a logic level to the high voltage level;

a second level shifter connected to an output of the NOR gate and converting a logic level to the high voltage level;

a first PMOSFET having a gate connected to a first level shift and a source connected to the high voltage terminal; and a first NMOSFET having a gate connected to a second level shift, a drain connected to the drain of the first PMOSFET, and a source being grounded, wherein the plurality of common cathode lines are connected to the first PMOSFET and the drain of the first NMOSFET.

6. The OLED panel driving apparatus according to claim 4, wherein;

the vertical synchronization signal is applied to a data input of a first;

the horizontal synchronization signal is applied to all clock ends of the shift registers; and an output of each of the shift registers is connected to a corresponding scan control signal $C_{SCAN}$ in the corresponding scan output unit, and to a data input of a next shift register.

7. The OLED panel driving apparatus according to claim 6, wherein the control logic unit is configured to include a number of 2-input XNOR gates corresponding to the number of the common cathode lines;

a first input of each of the XNOR gates is connected to an output of a corresponding shift register;

a second input end of each of the XNOR gates is connected to an output of a next row shift register; and an output of each of the XNOR gates is connected to the high impedance control signal $C_{HIZ}$ of a corresponding scan output unit.

8. The OLED panel driving apparatus according to claim 3, wherein the data driving circuit further comprises:

a shift register/latch unit for sequentially shifting and storing the data applied to each common anode line in accordance with a control signal from the OLED control circuit; and a PWM generating unit for converting the data supplied from the shift register/latch unit into a PWM control signal having time widths varying in accordance with gray level of the data, and transmitting the PWM control signal to the corresponding data output unit.

9. The OLED panel driving apparatus according to claim 8, wherein each of the data output units comprises:

a second PMOSFET and a third PMOSFET to form current mirror circuits;

a third level shifter for converting the logic level of the PWM control signal supplied from the PWM generating unit into the high voltage level; and a fourth PMOSFET for selectively connecting the corresponding common anode line to the constant current source and setting the high impedance terminal HIZ "on"/"off" by the third level shifter.

10. The OLED panel driving apparatus according to claim 9, wherein each of the data output units further comprises a second NMOSFET for grounding the common anode line with "on" by an outer control signal Reset in the "off" state of the fourth PMOSFET.

11. A method for driving an OLED panel having an OLED at each intersection of a plurality of common anode lines and a plurality of common cathode lines, which are aligned in a matrix configuration to form a pixel, the method comprising:

applying constant current to the plurality of common anode lines by a PWM control signal having time widths varying in accordance with a gray level of displayed pixel data while sequentially scanning and converting each one of the common cathode lines to ground during a horizontal scanning time interval;

connecting the common cathode line selected to be scanned to ground during the horizontal scan time interval;

refreshing the common cathode line connected to ground by connecting the common cathode line to a predetermined high voltage level during a next horizontal scan time interval; and, maintaining the common cathode line connected to the predetermined high voltage level in a high impedance state prior to scanning.

* * * * *

UNITED STATES PATENT AND TRADEMARK OFFICE

CERTIFICATE OF CORRECTION

PATENT NO. : 6,914,388 B2
DATED : October 25, 2005
INVENTOR(S) : H. J. Shin et al.

It is certified that error appears in the above-identified patent and that said Letters Patent is hereby corrected as shown below:

Column 11,
Line 7, "to a the" should be -- to the --.
Line 20, after "terminal" insert -- , --.
Line 65, after "first" insert -- shift register --.

Signed and Sealed this

Twenty-first Day of February, 2006

JON W. DUDAS
*Director of the United States Patent and Trademark Office*

UNITED STATES PATENT AND TRADEMARK OFFICE

CERTIFICATE OF CORRECTION

PATENT NO. : 6,914,388 B2
DATED : July 5, 2005
INVENTOR(S) : H. J. Shin et al.

It is certified that error appears in the above-identified patent and that said Letters Patent is hereby corrected as shown below:

Column 11,
Line 7, "to a the" should be -- to the --.
Line 20, after "terminal" insert -- , --.
Line 65, after "first" insert -- shift register --.

This certificate supersedes Certificate of Correction issued February 22, 2006.

Signed and Sealed this

Twenty-eighth Day of March, 2006

JON W. DUDAS
*Director of the United States Patent and Trademark Office*